US005820806A

United States Patent [19]

Cloos et al.

[11] Patent Number: 5,820,806

[45] Date of Patent: Oct. 13, 1998

[54] PROCESS FOR THE PREPARATION OF POLYKETONE FIBERS

[75] Inventors: Peter Jeroen Cloos, Duiven; Hendrik ter Maat, Rijssen; Gert Jan Jongerden, Velp, all of Netherlands

[73] Assignee: Akzo Nobel NV, Arnhem, Netherlands

[21] Appl. No.: 799,889

[22] Filed: Feb. 13, 1997

Related U.S. Application Data

[63] Continuation of Ser. No. 464,881, Jun. 29, 1995, abandoned.

[30] Foreign Application Priority Data

Jan. 13, 1993 [NL] Netherlands ..... 9300060

[51] Int. Cl.[6] ..... D01D 5/04; D01D 5/06; D01D 5/16; D01F 6/26

[52] U.S. Cl. ..... 264/203; 264/205; 264/210.8

[58] Field of Search ..... 264/203, 205, 264/210.8

[56] References Cited

U.S. PATENT DOCUMENTS 5,194,210 3/1993 Lommerts et al. ..... 264/203 X

FOREIGN PATENT DOCUMENTS 121965 10/1984 European Pat. Off. .
222454 5/1987 European Pat. Off. .
227135 7/1987 European Pat. Off. .
228733 7/1987 European Pat. Off. .
229408 7/1987 European Pat. Off. .
235865 9/1987 European Pat. Off. .
235866 9/1987 European Pat. Off. .
239145 9/1987 European Pat. Off. .
245893 11/1987 European Pat. Off. .
246674 11/1987 European Pat. Off. .
246683 11/1987 European Pat. Off. .
248483 12/1987 European Pat. Off. .
253416 1/1988 European Pat. Off. .
254343 1/1988 European Pat. Off. .
257663 3/1988 European Pat. Off. .
259914 3/1988 European Pat. Off. .
262745 4/1988 European Pat. Off. .
263564 4/1988 European Pat. Off. .
264159 4/1988 European Pat. Off. .
272728 6/1988 European Pat. Off. .
277695 8/1988 European Pat. Off. .
360358 3/1990 European Pat. Off. .
456306 11/1991 European Pat. Off. .
90/14453 11/1990 WIPO .
92/10524 6/1992 WIPO .

*Primary Examiner*—Leo B. Tentoni
*Attorney, Agent, or Firm*—Richard P. Fennelly

[57] ABSTRACT

It has been found that fibres can be spun in a simple manner from polyketone polymer solutions by making a thermoreversible gel from a solution of polyketone and a solvent for the polymer having a boiling temperature above 443 K, a melting temperature below 373 K, and a polymer dissolving temperature above 443 K. The thermoreversible gel forms as the solution is cooled. Because of the specific properties of the solvent in combination with the concentration of the polymer and its intrinsic viscosity, a permanently orientable thermoreversible gel is formed by cooling. The polymer crystallises on being cooled, optionally while still in the presence of the solvent. Preferably, so much polymer is dissolved as will give a product of the polymer concentration and $[\eta]^{0.5}$ (wherein $[\eta]$ represents the intrinsic viscosity of the polymer) of higher than 0.35 $(dl/g)^{0.5}$.

11 Claims, 1 Drawing Sheet

PROCESS FOR THE PREPARATION OF POLYKETONE FIBERS

This is a continuation of application Ser. No. 08/464,881 filed Jun. 29, 1995, now abandoned, which is a 371 of PCT/EP 94/00061, filed Jan. 7, 1994.

BACKGROUND OF THE INVENTION

The invention relates to a process for the preparation of fibres of a linear polymer of alternating ethylene and carbon monoxide units, in which process the polymer is dissolved in an appropriate solvent having a boiling temperature above 443 K (170° C.), a melting temperature below 373 K (100° C.), and a polymer dissolving temperature above 443 K (170° C.), the polymer solution, after being moulded, is converted to a thermoreversible gel by cooling, and the solvent is removed from the obtained product.

Such a process is known from International Patent Application WO 92/10524, which describes intermixing an ethylene/carbon monoxide copolymer with a second component to produce polymer compositions suitable for making gel-based articles, amongst others components capable of dissolving the polymer and spinning it into fibres, and components which cause the polymer to swell and are not considered suitable for fibre production.

According to this very general description, it is possible to prepare a thread-like, thermoreversible gel using the aforementioned polymer dissolving means, but none of said substances has proved easily suited to practical use. For instance, many of the solvents and swelling agents mentioned have a low boiling point, which results in slow crystallisation of the polymer in the solution on cooling. Also described are solvents which in practice were found to dissolve the polyketone less readily if higher concentrations are employed. Not a single practical example of good quality fibres being prepared from such solvents is provided. The only example in which a highly concentrated solution is prepared uses benzoic acid as a solvent, but this solvent was found to be unsuitable for the preparation of good quality fibres because of interference between the solvent and polymer crystallisation as the solution cools, which has an adverse effect on the mechanical properties of the products to be obtained. It was further found that benzoic acid breaks down the polyketone polymer.

SUMMARY OF THE INVENTION

A process has now been found which is free of these drawbacks. This process of the type mentioned in the opening paragraph provides a highly economical method of preparing polyketone fibres of favourable mechanical properties, and is characterised in that a permanently orientable thermoreversible gel is formed.

Use is made in this process of a comparatively poor polymer solvent, with such a high polymer concentration in the solvent being selected as will give sufficient and homogeneous intermingling of the polymer's molecular chains. The polymer crystallises on cooling, without the solvent needing to have been removed. Thus, a thermoreversible gel of such properties is formed by cooling as will permit drawing of the gel without removal of the solvent. The drawing process serves to permanently orient the polymer's molecular chains.

According to the novel process, it is possible to obtain at a high rate and in large quantities a fibre having favourable mechanical properties and from which the solvent can be removed comparatively easily.

In general, so much polymer is dissolved in order to prepare a permanently orientable thermoreversible gel that the product of the polymer concentration and $[\eta]^{0.5}$ is higher than 0.35 $(dl/g)^{0.5}$. $[\eta]$ in this process was measured in an m-cresol solution at 298 K (25° C.).

Although the fact that WO 92/10524 describes, in a very general way, the possibility of preparing highly concentrated solutions, the statement that a minute portion of the mentioned means forms solvents for the polymer from which permanently orientable fibres can be made, has not been substantiated, nor has been indicated when and/or how these can be obtained.

The process now found comprises the following components:

- polyketone polymer of the proper intrinsic viscosity, a mediocre or even poor solvent in which the polymer takes up a comparatively small hydrodynamic volume, and
- a device for thoroughly intermixing the polymer and the solvent at a relatively high temperature and with forceful mechanical agitation. Hydrodynamic volume is defined as the product of the intrinsic viscosity of the polyketone polymer in a particular solvent at the processing temperature and the average molecular weight.

DESCRIPTION OF THE PREFERRED EMBODIMENTS

Figure 1:
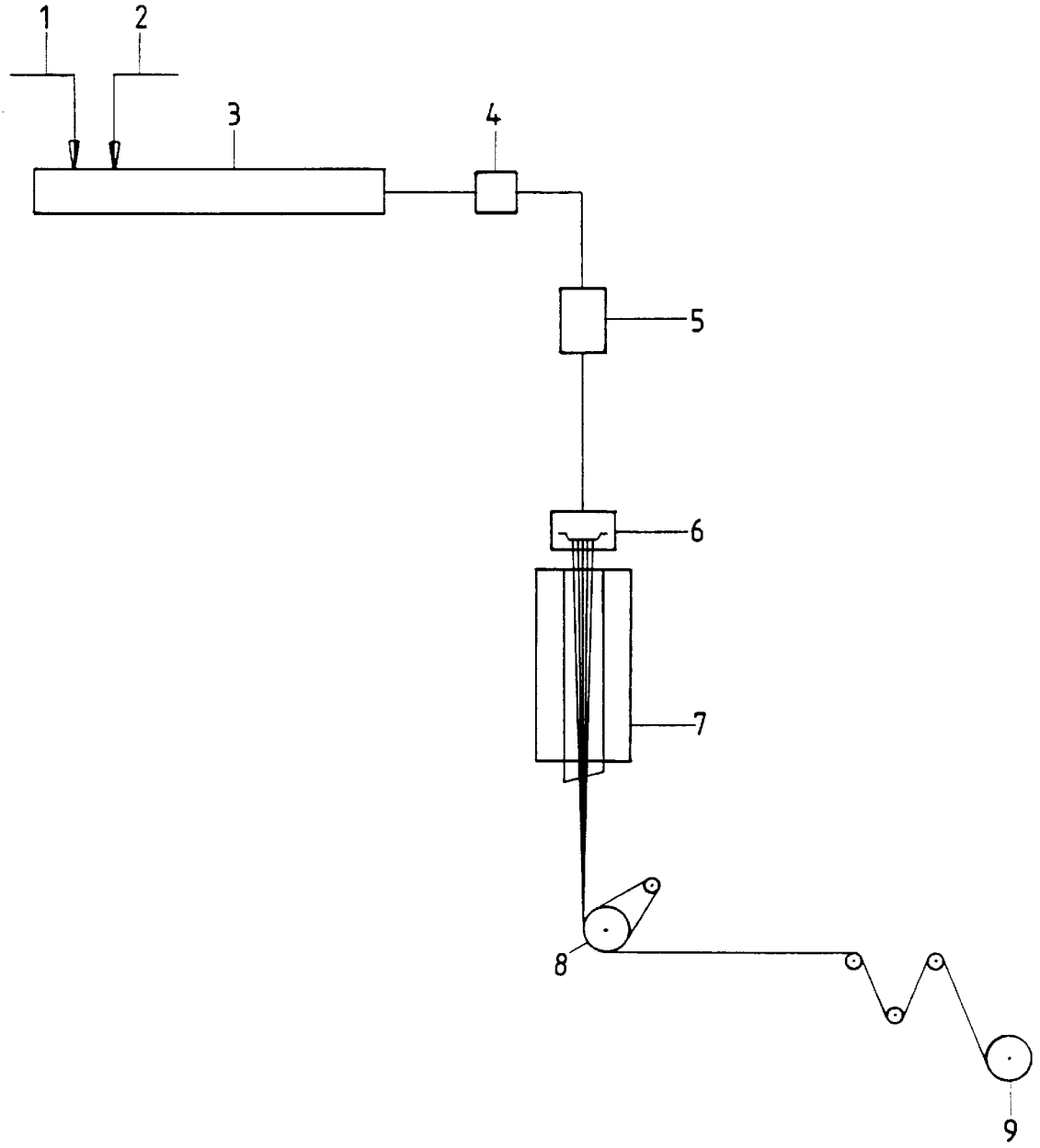

According to the process found, these components are utilised such that:

- a homogeneous solution is formed in such a concentration as will have overlapping of the molecular chains, which overlapping is preserved after cooling to below the crystallisation temperature of the solution,
- the homogeneous solution is extruded, and
- the resulting extrudate rapidly gels as it is cooled on account of the formation of crystalline nuclei, causing a thermoreversible gel to be formed which is drawable to a draw ratio ($\lambda$) of at least 6 and by being drawn to a draw ratio between 6 and 13 produces an oriented fibre with an initial modulus equal to or higher than $10/9\cdot\lambda-2.5$ (N/tex). Preferably, an oriented fibre with an initial modulus higher than $10/9\cdot\lambda-1.75$ (N/tex) is obtained. In a further preferred embodiment, the initial modulus is at least $10/9\cdot\lambda-1$ (N/tex), but will be less than $10/9\cdot\lambda+4$ (N/tex). The optimal oriented fibre will have an initial modulus which at least fulfills the equation:

$$0.259+1.752.\lambda-0.114.\lambda^2+0.00625\lambda^3-0.00009\lambda^4.$$

Thus, in the present invention, a permanently orientable thermoreversible gel is formed if said gel is drawable to a draw ratio of at least 6 and if from said gel an oriented fibre can be obtained which has an initial modulus in the range of $10/9\cdot\lambda-2.5$ (N/tex) to $10/9\cdot\lambda+4$ (N/tex) for a draw ratio between 6 and 13.

The process now found is so exceptional in particular because it is not subject to the drawbacks of traditional gel spinning and comes very close to the meltspinning process which is so economically advantageous. This is advantageous in particular for some types of ethylene and carbon monoxide units containing polymers which are not melt processable on account of their degradation at the temperature required for polymer melt processing.

The solvents used are those which are generally considered to be so-called poor solvents for the polymer. The boiling point of these solvents is above 443 K (170° C.), more particularly above 453 K (180° C.), and in a most preferred embodiment above 477 K (204° C.). These solvents will not dissolve the polymer in its entirety except with heating to a temperature above 443 K (170° C.), preferably to above 453 K (180° C.), and most preferably to above 477 K (204° C.). In most cases, the temperature at which there is virtually complete polymer dissolution lies below the boiling point of the solvent, so that the dissolving process can easily be carried out under atmospheric pressure. In the case of a number of solvents, a suitable process for preparing a polymer solution lies in selecting a dissolving temperature equal to or higher than the boiling point of the solvent. Such a process may be carried out with advantage when, e.g., benzyl alcohol is used as solvent. At temperatures which do not exceed the boiling temperature by more than 5 K (5° C.), operating under a pressure above 100 kPa will not be required in every case. At higher temperatures, however, this requirement will always be there.

The dissolving temperature of polyketone in a particular solvent is defined as the temperature at which virtually complete dissolution of 5–10 wt. % of polyketone having an intrinsic viscosity of about 7 is observed in that particular solvent.

Selecting the polymer concentration such that the product of the polymer concentration and $[\eta]^{0.5}$ is higher than 0.35 $(dl/g)^{0.5}$ will give a solution in which the molecular chains of the polymer are sufficiently intermingled to form the desired thermoreversible gel upon crystallisation. $[\eta]$ is measured in an m-cresol solution at a temperature of 298 K (25° C.). In this formula the polymer concentration is expressed as the fraction by weight of polymer in the solution. A very satisfactory process consists in so selecting the polymer concentration that the solution's crystallisation temperature lies between 398 K (125° C.) and the boiling point of the solvent.

It has been found that while using a solvent which satisfies the above-mentioned characteristics at lower polymer concentrations will allow a homogeneous solution to be obtained, such a low-concentration solution of a solvent according to the invention will lead to phase separation upon cooling. In the case of such cooled solutions it is no longer possible to speak of a permanently orientable thermoreversible gel. The products obtained from such low-concentration solutions have mechanical properties which are inadequate for use, This was earlier described in EP 456 306.

In the preparation of a solution to form a thermoreversible gel the cohesion between the chains, and thus the gelling, may be enhanced by so selecting the concentration of a polymer having a given intrinsic viscosity that the product of the polymer concentration and $[\eta]^{0.5}$ is higher than 0.4 $(dl/g)^{0.5}$. More favourable results still are attained if the product of the polymer concentration and $[\eta]^{0.5}$ is higher than 0.5 $(dl/g)^{0.5}$.

Not only are the properties of the end products manufactured from such solutions enhanced, using high polymer concentrations also has advantages as regards the amount of polymer processed per unit of time and the rate at which the solvent can be removed from the product. In the aforesaid equation $[\eta]$ represents the intrinsic viscosity of the polymer and is determined as follows:

$$[\eta] = \lim_{c \to 0} \frac{\eta spec}{c} = \lim_{c \to 0} \frac{t - t_o}{t_o \cdot c}$$

so having the meaning of the ratio between the flow times t and $t_o$, with $t_o$ and t representing the flow time of the solvent and the polymer-containing solution, respectively, in a capillary viscometer at 298 K (25° C.). c in this equation has the meaning of the polymer concentration in m-cresol, expressed in grams per deciliter.

The intrinsic viscosity of the polyketone used generally is in the range of 0.5 to 10 dl/g but may be higher. Polyketone highly suited to be used in the process now found has an intrinsic viscosity in the range of 1.2–8 dl/g, in particular in the range of 1.2–4.5 dl/g. Very suitable polyketone for use in the present invention has an intrinsic viscosity in the range of 1.2–2.5 dl/g. The relation between the estimated molecular weight (Mw) (in grams per mole) and the intrinsic viscosity as utilised here can be established with the aid of the following formula:

$$[\eta] = 1.0 \times 10^{-4} \times Mw^{0.85}$$

The polyketone polymer is primarily composed of alternating carbon monoxide and ethylene units according to the formula:

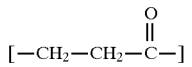

In addition to carbon monoxide and ethylene units, this polymer may contain a small amount of other units, for instance propylene groups. Also, other substances may be admixed, e.g., to improve the thermal and/or oxidative properties and/or other polymer and/or fibre properties. For the preparation of polyketone polymers reference is made to the following European Patent Specifications: 121 965; 222 454; 227 135; 228 733; 229 408; 235 865; 235 866; 239 145; 245 893; 246 674; 246 683; 248 483; 253 416; 254 343; 257 663; 259 914; 262 745; 263 564; 264 159; 272 728; and 277 695.

It is not possible to prepare the desired thermoreversible gel which can be permanently oriented without the solvent having to be removed if solvents are used of which the polymer dissolving temperature is lower than that mentioned in the claims. Using such solvents will result in thermoreversible gels which are far closer in character to gels prepared with a satisfactory solvent, which means, int. al., that the solvent cannot be removed from the obtained products without extraction, and the polymer concentration in the solutions obtained cannot be as high as presently found.

The process now found has the significant advantage of the polymer being crystallised by cooling under normal spinning operation conditions, such as normal cooling speed, while the processes hitherto known always required that an extracting agent be employed to carry out the desired polymer crystallisation. In a highly preferred embodiment of the present invention, the polymer is crystallised by cooling to room temperature under normal spinning conditions. Since the polymer is crystallised by cooling of the extrudate, it is possible to directly orient the molecular chains, e.g., by drawing the formed thermoreversible gel. Using the solvents according to the present invention in a great many cases renders solvent extraction with the aid of an extracting agent unnecessary. Thus, it was found that the formed thermoreversible gel may be drawn directly on exiting from the extruder, optionally after first being passed, under low tension or virtually tensionless, along a source of heat. A preferred embodiment consequently is found in a process according to said invention in which at least 50% of the solvent is removed from the extruded product by a means other than extraction.

The solvents to be employed according to the present invention have a melting point below 373 K (100° C.). If the melting point is comparatively high, the solvent and polymer crystallisations will be subject to interference upon cooling. This brings about substantial deterioration of the mechanical properties of the fibres to be obtained. Accordingly, the melting point of an appropriate solvent according to the present invention will be less than 373 K (100° C.),more particularly less than 318 K (45° C.).The properties of the obtained fibres were found to have improved with the lowering of the solvent melting point.

Considered to be highly suitable are solvents containing at least one component from the group made up of:

2-methoxy phenol, 2-hydroxypropionphenone, diethylene glycol, dipropylene glycol, triethylene glycol, anhydroerythritol, thiodiethylene glycol, 5-methyl-2-pyrrolidinone, N-methyl-2-oxazolidinone, N-formyl piperidine, dimethyl phthalate, benzyl alcohol, γ-butyrolactone, ϵ-caprolactam, dimethyl sulphoxide, ethylene carbonate, and propylene carbonate. These solvents are held to be suitable in particular because they have no or only very low toxicity and do not cause polymer degradation, and because the temperature at which the polymer dissolves is in a favourable range.

Particularly significant in this connection are those solvents which contain at least one component from the group made up of:

ethylene carbonate, propylene carbonate, benzyl alcohol, γ-butyrolactone, ϵ-caprolactam, dimethyl phthalate, and dipropylene glycol. Notably ethylene carbonate, propylene carbonate, and benzyl alcohol, in combination or not with one or more other substances, were found to be highly suitable solvents. Thus, the solvents to be used may be made up of one or more of the aforementioned components, but also contain other components. The important thing is that the mixture continues to satisfy the criteria for the solvent as given in the claims.

In actual practice, a number of solvents proved to be less suitable for use. The criteria which are considered relevant with regard to the practical use of such materials are listed below.

Thus, solvents which are deemed suitable should be of low toxicity and/or cause little or no irritation, so that their handling does not call for any additional measures. For that reason, solvents containing a substantial amount of phenol are not suitable for use according to the present invention.

Also, for economic reasons, the solvents should be comparatively inexpensive. In addition, they should be chemically inert with regard to the polymer. For instance, it was found that, at elevated temperature, benzoic acid and aniline break down the polyketone polymer. Furthermore, solutions prepared with the aid of the solvent will have to be reproducible in order to facilitate continuous spinning operations.

The solution according to the present process may be prepared in the aforementioned concentration by intimate mixing of the solvent and the polymer with increasing temperature, followed by extrusion moulding of the solution. Thus, the preparation of the solution may take the form of feeding the polymer and the solvent to a kneading apparatus, and then using a spinning pump to press the mixture through an extrusion plate at elevated temperature. The temperature at which the solution is extruded preferably is above 453 K (180° C.), but lower than the polymer degradation temperature. The polymer and the solvent may be mixed either in the kneading apparatus itself or intermixed in advance, with the resulting mixture, the suspension, subsequently being passed to the kneading apparatus. The solution is obtained by heating the mixture to or above the temperature at which the polymer dissolves. This temperature should be lower than the temperature at which there is substantial thermal decomposition of the polymer. A process suited to practical use is found by selecting the temperature lower than the solvent's boiling point at the prevailing operating pressure in the kneading apparatus, and higher than the polymer's dissolving point in the solvent at this operating pressure. More particularly, a temperature in the range of about 453 to 513 K (180° to 240° C.) is employed, depending on the solvent used.

According to one process very suited to practical use for preparing solutions containing polymer concentrations of over 70 wt. %, up to even 95 wt. %, based on the weight of the solution, the polymer and the solvent are fed to a kneading apparatus equipped with one or more screws in order to subject the mixture to mixing and kneading at high mechanical shear rates. More particularly, the kneading apparatus used is a twin-screw extruder, although also a single-screw extruder or another high shear kneader can very well be applied. In particular, the use of a twin-screw extruder is consider advantageous, since in such a mixing means the mixture is mixed and heated as well as transported. The construction of the screw is such as to give a short stay and low dispersion during that stay, which serves to counter polymer degradation and will benefit the constant quality of the solution to be obtained. In the kneading extruder the polymer's stay and temperature can be set in relation to the concentration and the solvent employed. For instance, it has been found that a stay in the range of about 1 to 5 minutes was very suitable for heating the mixture sufficiently for both dissolving and extruding purposes. Using such a twin-screw extruder makes it possible to obtain solutions with a very high polymer concentration. In addition, it is possible to operate under a pressure in excess of 100 kPa if so desired, without this giving any problems.

According to a very favourable method, the kneading extruder is connected to a spinning unit, and the resulting solution is fed directly to the spinning pump. After extrusion the solvent can be removed by evaporation, e.g., by passing the solution through a heated tube, along a hotplate, or by a flow of hot air.

The polymer will be crystallised by cooling. Cooling may take the form of air cooling, water cooling, water vapour cooling, passing over cooled rollers or through a bath containing a cooling liquid, or of a combination of cooling techniques.

Alternatively, the extruded product may be drawn following its extrusion at elevated temperature or not, with the solvent being removed from the product either by the drawing process itself or by the heat applied during the drawing.

FIG. 1 shows the process according to a preferred embodiment of the present invention, which does without an extracting agent to remove the solvent. At (1) the polymer is charged and at (2) the solvent, whereupon both are heated in the twin-screw extruder (3) to the desired temperature, which will be above 443 K (170° C.). (4) represents the spinning pump and (5) the filter through which the solution is pressed. The solution is pressed through the spinneret, referred to here as the extrusion plate (6), and the obtained extrudates are guided through a heated tube (7), after which, via a separator roll (8) and with the aid of a winder (9), the resulting fibres are wound onto a bobbin.

The mechanical properties of the fibres are measured on filaments that have been conditioned at 21° C. and 65% relative humidity for at least 16 hours. The breaking tenacity (BT), elongation at break (EAB), initial modulus (IM), and final modulus (FM) are obtained by breaking a single filament in a tensile tester. The gauge length for the filaments is 100 mm. The samples are elongated at a constant extension rate of 10 mm/min.

The breaking tenacity and the elongation at break are obtained from the stress-strain curve as defined in ASTM D 2256-88. The initial and final moduli are obtained from the first derivative of the stress-strain curve (the modulus-strain curve) as the maximum moduli for a strain smaller than 0.2% and a strain larger than 2%, respectively. The linear density of the filaments (LD, expressed in dtex) is calculated on the basis of the functional resonance frequency as defined in ASTM D 1577-66, or by weighing of the filaments.

EXAMPLE 1

Several substances were tested for their serviceability as solvents for the process according to the present invention. To this end polyketone polymer having an intrinsic viscosity as indicated below was added to a quantity of the substance mentioned below and slowly heated in an atmosphere of nitrogen. After complete dissolving of the polymer or the attaining of a temperature of 523 K (250° C.), the obtained substance was left to slowly cool.

The following substances were employed:

benzoic acid: boiling point 522 K (249° C.), melting temperature 396 K (123° C.)

benzyl alcohol: boiling point 483 K (210° C.), melting temperature 258 K (−15° C.)

ϵ-caprolactam: boiling point 543 K (270° C.), melting temperature 343 K (70° C.)

N-methyl-2-pyrrolidone: boiling point 475 K (202° C.), melting temperature 249 K (−24° C.).

(COMPARATIVE EXAMPLE)

I a

Prepared was a 2%-solution of polyketone ([η] 9.8 and benzoic acid by heating in an atmosphere of nitrogen. At 396 K (123° C.) the benzoic acid melted. At 468 K (195° C.) the polymer had dissolved completely, the solution being faintly yellow in colour. On being cooled, the solution first became cloudy and then finally crystallised at a temperature of 433 K (160° C.), with phase separation of the benzoic acid and the polymer being observed.

I b

Prepared was a 4%-solution of polyketone ([η] 9.8) and benzyl alcohol. The benzyl alcohol wets the polymer straightaway. At 443 K (170° C.) the polymer had dissolved completely, and a clear solution was obtained. On preparing a 30%-solution of polyketone ([η] 1.3) and benzyl alcohol the polymer was found to have dissolved completely at a temperature of 472 K (199° C.). The polymer crystallised at 418 K (145° C.).

I c

Prepared was a 4%-solution of polyketone ([η] 9.8) and ϵ-caprolactam. The caprolactam melted at 353 K (80° C.) and at 413 K (140° C.) caused the polymer to swell. At 503 K (230° C.) the polymer had dissolved completely, and a clear solution was obtained. On being cooled, the solution crystallised at a temperature of 438 K (165° C.).

(COMPARATIVE EXAMPLE)

I d

Prepared were two 30%-solutions of polyketone ([η] 1.3) from the same production batch and N-methyl-2-pyrrolidone.

In a manner known in itself thermal analyses were carried out by repeatedly heating and cooling the contents of the closed vessel. The identically prepared solutions were found to have different temperatures for complete polymer dissolution. Heating the solutions a second time produced lower temperatures, which is indicative of polymer degradation. The temperatures found for the first and second heatings were 491 K (218° C.) and 483 K (210° C.) and 476 K (203° C.) and 473 K (200° C.), respectively. Repeating this test with polyketone of a different intrinsic viscosity ([η]=8.4) showed a similar range at other temperatures. These results are so far apart that the preparation of polymer solutions of N-methyl-2-pyrrolidone and polyketone of sufficiently reproducible quality does not appear very feasible.

These examples already show that benzoic acid is not a suitable solvent for the preparation of fibres according to the present process. The use of N-methyl-2-pyrrolidone is likewise attended with drawbacks which render it unsuitable for use in actual practice. By contrast, very satisfactory solutions highly suited to practical use can be prepared using the solvents mentioned in Examples I b and I c.

EXAMPLE II

Solutions were prepared from polyketone having a molecular weight and an intrinsic viscosity [η] as listed in the table. The polyketone was composed of carbon monoxide and ethylene units and contained neither stabilisers nor any other additives.

The polymer, in the powdered form, was charged to a twin-screw extruder, where it was slowly heated to 353 K (80° C.). To the polymer of this temperature (353 K [80° C.]) the solvent was added, after which the mixture was dissolved by the kneading action of the extruder and the appropriate temperature settings to above the temperature at which the polymer dissolves. This temperature was 493 K (220° C.) for the propylene carbonate solutions, 458 K (185° C.) for benzyl alcohol, and 453 K (180° C.) for the propylene carbonate/resorcinol mixtures. At the extruder's head there was a spinneret plate with two round orifices of 4 mm in diameter. The moulded strands were immediately cooled over three water-cooled rollers and then chopped up into pellets of about 3 mm.

Rapid cooling caused the solvent to be retained in the solution, as a result of which solid solutions in the shape of pellets were obtained. In this manner the following solutions were prepared:

TABLE I

| | solvent | set concentration | Mw [kg/kmole] | [η] [dl/g] | c.[η]$^{0,5}$ [dl/g]$^{0,5}$ |
|---|---|---|---|---|---|
| 1 | prop. carbonate | 0.25 | 561 000 | 7.7 | 0.6937 |
| 2 | prop. carbonate | 0.17 | 561 000 | 7.7 | 0.4717 |
| 3 | prop. carbonate | 0.33 | 485 000 | 6.8 | 0.8605 |
| 4 | resorcinol/prop. carbonate 35/65 | 0.25 | 468 000 | 6.6 | 0.6422 |
| 5 | resorcinol/prop. carbonate 35/65 | 0.275 | 561 000 | 7.7 | 0.763 |
| 6 | resorcinol/prop. carbonate 35/65 | 0.30 | 561 000 | 7.7 | 0.8324 |
| 7 | prop. carbonate | 0.25 | 561 000 | 7.7 | 0.6937 |
| 8 | benzyl alcohol | 0.20 | 410 000 | 5.9 | 0.4858 |
| 9 | benzyl alcohol/prop. carbonate 75/25 | 0.18 | 561 000 | 7.7 | 0.4994 |

EXAMPLE III

EXAMPLE III

The pellets made from solutions 1 and 8 in Example II were fed to a single-screw extruder with at its mouth a spinneret provided with a spinneret plate having 26 round orifices, each of 250 μm in diameter. The solutions were extruded and the formed extrudates crystallised by being cooled in air. The obtained solid filaments were washed out with water and subsequently drawn over a matt chromed pin heated at 509 K (236° C.) and two or three 34 cm long heated plates. The draw ratios of the spun fibres, the temperatures of the heated plates, and the mechanical properties found for the fibres are given in Tables II and III .

TABLE II

| no. sol | draw ratio | plate temp. [K(°C.)] 1/2 | LD [dtex] | BT [mN/tex] | EAB [%] | IM [N/tex] | FM [N/tex] |
|---|---|---|---|---|---|---|---|
| 1 | 13.0 | 518/522(245/249) | 15.6 | 950 | 5.3 | 16 | 22 |
| 1 | 13.0 | 518/522(245/249) | 16.8 | 1000 | 5.9 | 15 | 22 |
| 1 | 13.0 | 518/522(245/249) | 15.3 | 1100 | 5.6 | 18 | 24 |
| 1 | 11.1 | 518/522(245/249) | 17.7 | 1280 | 7.7 | 14 | 20 |
| 1 | 11.1 | 518/522(245/249) | 18.4 | 1210 | 7.2 | 14 | 21 |
| 1 | 11.1 | 518/522(245/249) | 15.6 | 1320 | 7.3 | 15 | 22 |

LD: Linear density, BT: breaking tenacity, EAB: elongation at break IM: initial modulus, FM: final modulus.
The measured concentration of solution 1 was 0.34. The product of the concentration and $[\eta]^{0.5}$ thus was 0.9435 $(dl/g)^{0.5}$.

The measured concentration of solution 1 was 0.34. The product of the concentration and $[\eta]^{0.5}$ thus was 0.9435 $(dl/g)^{0.5}$.

TABLE III

| no. sol | draw ratio | plate temp. [K(°C.)] 1/2/3 | LD [dtex] | BT [mN/tex] | EAB [%] | IM [N/tex] | FM [N/tex] |
|---|---|---|---|---|---|---|---|
| 8 | 10.2 | 519 | 22.6 | 870 | 7.6 | 9.6 | 14 |
| 8 | 11.2 | 519/526 (246/253) | 17.9 | 880 | 6.4 | 12 | 17 |
| 8 | 13.0 | 519/529 (246/256) | 14.8 | 1230 | 5.6 | 18 | 26 |
| 8 | 13.0 | 519/529 (246/256) | 18.7 | 980 | 5.7 | 15 | 21 |
| 8 | 14.6 | 519/526/528 (246/253/255) | 19.0 | 1000 | 4.9 | 17 | 24 |
| 8 | 14.6 | 519/526/528 (246/253/255) | 15.7 | 960 | 5.1 | 16 | 22 |

LD: Linear density, BT: breaking tenacity, EAB: elongation at break IM: initial modulus, FM: final modulus.
The measured concentration of solution 8 was 0.29. The product of the concentration and $[\eta]^{0.5}$ was 0.7 $(dl/g)^{0.5}$.

The measured concentration of solution 8 was 0.29. The product of the concentration and $[\eta]^{0.5}$ was 0.7 $(dl/g)^{0.5}$.

EXAMPLE IV

The method as described in Example II was used to prepare fibres from Example II's solution no. 9, except that this time the obtained filaments were not drawn over hotplates, but in a single step in a hot oven at a temperature of 498 K (225° C.). The properties of the resulting products are listed in Table IV.

TABLE IV

| draw ratio | LD [dtex] | BT [mN/tex] | EAB [%] | IM [N/tex] | FM [N/tex] |
|---|---|---|---|---|---|
| 14.4 | 15.3 | 760 | 5.6 | 12 | 16 |
| 14.4 | 15.3 | 680 | 4.6 | 13 | 17 |
| 9.3 | 29.6 | 550 | 5.6 | 10 | 11 |
| 18.3 | 12.5 | 750 | 4.5 | 16 | 19 |

TABLE IV-continued

| draw ratio | LD [dtex] | BT [mN/tex] | EAB [%] | IM [N/tex] | FM [N/tex] |
|---|---|---|---|---|---|
| 13.3 | 15.2 | 770 | 5.3 | 14 | 17 |
| 13.3 | 15.4 | 710 | 4.5 | 15 | 18 |

LD: Linear density, BT: breaking tenacity, EAB: elongation at break IM: initial modulus, FM: final modulus.
EXAMPLE V

EXAMPLE V

A solution of polyketone polymer and benzyl alcohol was prepared by charging powdered polyketone with an intrinsic viscosity of 2.93 and solvent to a twin-screw extruder. The temperature was 378 K (105° C.) in the first extruder zone and 453 K (180° C.) in the last one. The kneading action of the extruder and heating to 453 K (180° C.) caused the polymer to dissolve completely. The residence time of the polymer in the extruder was about 3 minutes. At the mouth of the extruder there was a spinneret with 10 orifices of 200 μm, through which the solution was passed. The temperature of the solution during the extrusion process was 458 K (185° C.), the pressure applied was 7200 kPa. The moulded extrudates were passed through a heated tube (T=498 K [225° C.]) and along a number of guide bars and wound onto a bobbin. The fibres from this bobbin were not drawn over hotplates, but in one or two steps in a heated oven. At the end of the drawing set-up there was a bobbin onto which the formed fibres were wound. The measured polyketone concentration in the solution was 0.50. The product of the concentration and $[\eta]^{0.5}$ was 0.86 $(dl/g)^{0.5}$.

The drawing conditions and the mechanical properties of the resulting products are listed in Table V

TABLE V

| draw ratio | oven temp[K(°C.)] | LD[1]) [dtex] | BT[1]) [mN/tex] | EAB[1]) [%] | IM[1]) [N/tex] | FM[1]) [N/tex] |
|---|---|---|---|---|---|---|
| 2 | 373 (100) | 372.0 | 68 | 31 | 0.8 | 0.5 |
| 4 | 373 (100) | 171.0 | 283 | 9.5 | 3.1 | 3.5 |
| 4 | 373 (100) | 138 | 350 | 9.3 | 4.3 | 4.9 |
| 4 | 498 (225) | 95 | 440 | 10.3 | 4.7 | 6.1 |
| 6 | 473 (200) | 100 | 430 | 6.1 | 6.7 | 9.2 |
| 6 | 498 (225) | 91.6 | 530 | 6.68 | 7.4 | 9.7 |
| 6 | 523 (250) | 93.5 | 737 | 8.14 | 7.9 | 11.8 |
| 8.1 | 313/498 (40/225) | 46.9 | 631 | 5.83 | 10.1 | 13.6 |
| 8.1 | 523 (250) | 74 | 910 | 6.81 | 11.7 | 17.0 |
| 10 | 313/523 (40/225) | 32 | 970 | 6.1 | 13.0 | 20.0 |

LD: Linear density, BT: breaking tenacity, EAB: elongation at break IM: initial modulus, FM: final modulus.
[1]): The averaged value for 10 measurements is given.
Example VI

EXAMPLE VI

A mixture of fine solid polyketone powder with an intrinsic viscosity of 1.35 and propylene carbonate was prepared at room temperature using a Brabender blender. The blend, having a total weight of approximately 15 grams, was homogenised for at least 15 minutes at a screw speed of 100 rpm.

Three grams of the so obtained samples were compression moulded into films between two aluminium carriers of 25 cm×35 cm. During compression at elevated temperature a polymer solution was formed. After the compression moulding procedure was completed, the film sample, including the aluminium carriers, was removed from the hot surface of the press and the package was subsequently cooled by being pressed with a cold copper plate on a metal base for at least 20 seconds.

The resulting film was cut up into strands with a size of 0.08–0.1 mm (thickness)×2 mm (width)×30 mm (length). Some of the strands were washed with acetone before being drawn. The conditions for the preparation of the strands are listed in Table VI. The strands were drawn in a single step in a hot oven. The drawing conditions and the properties of the resulting products are listed in Table VII.

TABLE VI

| strand no. | POK conc. | preload (10 s.) [kN] | Load [kN] | Loading time [s] | Temperature [K(°C.)] | strand washed |
|---|---|---|---|---|---|---|
| 1 | 0.71 | 20 | 20 | 90 | 493 (220) | no |
| 2 | 0.71 | 20 | 20 | 90 | 493 (220) | no |
| 3 | 0.71 | 20 | 20 | 90 | 493 (220) | yes |
| 4 | 0.71 | 20 | 20 | 90 | 493 (220) | no |
| 5 | 0.83 | 30 | 30 | 90 | 513 (240) | yes |

TABLE VII

| strand no. | draw ratio | oven temp [K(°C.)] | drawing speed [mm/sec] | BT [mN/tex] | IM [N/tex] | FM [N/tex] |
|---|---|---|---|---|---|---|
| 1 | 6 | 498(225) | 10 | 460 | 6.1 | 8.0 |
| 2 | 7 | 498(225) | 5 | 440 | 6.4 | 8.6 |
| 3 | 6 | 508(235) | 10 | 200 | 4.4 | 6.0 |
| 4 | 6 | 508(235) | 10 | 380 | 5.0 | 8.0 |
| 5 | 6 | 508(235) | 20 | 230 | 4.8 | 7.1 |

BT: breaking tenacity, IM: initial modulus. FM: final modulus.
The product of the concentration and $[\eta]^{0.5}$ thus was 0.82 $(dl/g)^{0.5}$ for the blend with a polyketone concentration of 0.71 and 0.96 $(dl/g)^{0.5}$ for the blend with a polyketone concentration of 0.83.

The product of the concentration and $[\eta]^{0.5}$ thus was 0.82 $(dl/g)^{0.5}$ for the blend with a polyketone concentration of 0.71 and 0.96 $(dl/g)^{0.5}$ for the blend with a polyketone concentration of 0.83.

It is also possible to use the blends for the preparation of fibres. Extruding these blends at elevated temperature, e.g., 513 K (240° C.), through capillaries of approximately 1000 μm, will produce fibres which after drawing at elevated temperature display mechanical properties similar to or even better than those of the drawn strands.

COMPARATIVE EXAMPLE 1

Solutions were prepared from polyketone having a molecular weight of 310 000 g/mole and an intrinsic viscosity [η] of 4.66 using dry propylene carbonate as solvent. Polymer was added in such a quantity as to give a percentage by weight of the polymer in the solution of 15. The product of the polymer concentration and $[\eta]^{0.5}$ accordingly was 0.32 $(dl/g)^{0.5}$.

The polyketone polymer was composed of carbon monoxide and ethylene units and contained neither stabilisers nor any other additives. The solution was prepared by heating the solvent and the polymer in a stirred beaker under nitrogen to 493 K (220° C.). The time required for dissolution was 120 minutes. The formed solution was passed through six spinning orifices of a diameter of 300 μm each in a spinning machine at 483 K (210° C.). 10 mm beneath the spinneret plate there was an extraction or coagulation bath filled with acetone of 250 K (−23° C.), through which the moulded extrudates were passed. Next, free of solvent, the fibres were drawn by being passed over one or more hotplates under tension, and wound.

Measurement of the mechanical properties produced the following results, which are listed in Table A1.

TABLE A1

| draw ratio | plate temp[K(°C.)] | LD [dtex] | BT [mN/tex] | EAB [%] | IM [N/tex] | FM [N/tex] |
|---|---|---|---|---|---|---|
| 8 | 513 (215) | 12.8 | 430 | 11.3 | 5 | 5 |
| 10 | 513 (215) | 11.1 | 570 | 8.9 | 6 | 8 |
| 12 | 513 (215) | 8.7 | 730 | 7.2 | 9 | 13 |
| 14 | 513 (215) | 7.2 | 840 | 6.7 | 12 | 15 |

LD: Linear density, BT: breaking tenacity, EAB: elongation at break IM: initial modulus, FM: final modulus.
COMPARATIVE EXAMPLE 2

COMPARATIVE EXAMPLE 2

A solution was prepared of polyketone having a molecular weight of 640 000 g/mole and an intrinsic viscosity [η] of 8.62 using dry propylene carbonate as solvent. Polymer was added in such a quantity as to give a percentage by weight of the polymer in the solution of 8. The product of the polymer concentration and $[\eta]^{0.5}$ accordingly was 0.08×2.93=0.23 $(dl/g)^{0.5}$.

The solution was prepared by heating the solvent and the polymer to 493 K (220° C.) in a stirred closed dissolving vessel under nitrogen. The time required for dissolution was 60 minutes. The formed solution was passed through a single spinning orifice of a diameter of 500 μm in a spinning machine at 483 K (210° C.). 10 mm beneath the spinneret plate there was an extraction or coagulation bath filled with acetone of 248 K (−25° C.), through which the formed extrudates were passed. Next, free of solvent, the fibres were drawn by being passed over one or more hotplates under tension, and wound. Measurement of the mechanical properties produced the following results, which are listed in Table A2.

TABLE A2

| draw ratio | plate temp[K(°C.)] | LD [dtex] | BT [mN/tex] | EAB [%] | IM [N/tex] | FM [N/tex] |
|---|---|---|---|---|---|---|
| 8 | 473(200) | 24.9 | 370 | 9.2 | 4 | 5 |
| 12 | 473/498(200/225) | 16.1 | 540 | 8.5 | 6 | 7 |
| 15 | 473/503(200/230) | 9.9 | 770 | 7.2 | 10 | 13 |
| 18 | 473/503(200/230) | 12.5 | 610 | 7.8 | 8 | 10 |
| 20 | 473/503(200/230) | 8.6 | 780 | 6.5 | 12 | 15 |
| 23 | 473/503(200/230) | 8.6 | 880 | 6.7 | 12 | 16 |
| 26 | 473/508(200/235) | 9.6 | 840 | 7.4 | 12 | 15 |

LD: Linear density, BT: breaking tenacity, EAB: elongation at break IM: initial modulus, FM: final modulus.

We claim:

1. A process for making a fiber of a linear polyketone polymer comprising alternating ethylene and carbon monoxide units, in which process the polymer is dissolved in an appropriate solvent having a boiling temperature above 443 K (170° C.), a melting temperature below 373 K (100° C.), and a polymer dissolving temperature above 443 K (170° C.), with the dissolving temperature in a particular solvent being defined as the temperature at which virtually complete dissolution of 5–10 wt. % of polyketone having an intrinsic viscosity of about 7 is observed in that particular solvent, and the polymer solution after being molded is converted to a thermoreversible gel by cooling, and the solvent is removed from the obtained product, characterized in that after extrusion of the polymer solution and cooling, the gelled extrudate is formed to a fiber before or after its conversion to a thermoreversible gel, which is drawable to a draw ratio of at least 6, and the polymer solution contains so much dissolved polymer that the product of the polymer concentration and $[\eta]^{0.5}$, with the polymer concentration being expressed as the fraction by weight of polymer in the solution and $[\eta]$ being measured in an m-cresol solution at 298 K (25° C.), is higher than 0.35 $(dl/g)^{0.5}$ and has such properties that a fiber formed therefrom when being drawn to a draw ratio between 6 and 13 produces an oriented fiber with an initial modulus in the range of $10/9\cdot\lambda-2.5$ (N/tex) to $10/9\cdot\lambda+4$ (N/tex).

2. A process according to claim 1, characterised in that the product of the polymer concentration and $[\eta]^{0.5}$ is higher than 0.4 $(dl/g)^{0.5}$.

3. A process according to claim 2, characterised in that so much polymer is dissolved that the product of the polymer concentration and $[\eta]^{0.5}$ is higher than 0.5 $(dl/g)^{0.5}$.

4. A process according to any one of claims 1–3, characterised in that the solvent contains at least one component selected from the group consisting of: 2-methoxy phenol, 2-hydroxypropionphenone, diethylene glycol, benzyl alcohol, dipropylene glycol, triethylene glycol, anhydroerythritol, thiodiethylene glycol, 5-methyl-2-pyrrolidinone, N-methyl-2-oxazolidinone, N-formyl piperidine, dimethyl phthalate, γ-butyrolactone, dimethyl sulphoxide, ethylene carbonate, propylene carbonate, and ε-caprolactam.

5. A process according to any one of claims 1–3, characterised in that the solvent contains at least one component selected from the group consisting of: ethylene carbonate, propylene carbonate, benzyl alcohol, γ-butyrolactone, ε-caprolactam, dimethyl phthalate, and dipropylene glycol.

6. A process according to any one of claims 1–3, characterised in that the solvent contains at least one component selected from the group consisting of: propylene carbonate, ethylene carbonate, and benzyl alcohol.

7. A process according to any one of claims 1–3, characterised in that the solvent has a boiling point of above 477 K (204° C.).

8. A process according to any one of claims 1–3, characterised in that the melting point of the solvent is below 318 K (45° C.).

9. A process according to any one of claims 1–3, characterised in that the polymer dissolving temperature is in range of 453 K (180° C.) to 513 K (240° C.).

10. A process according to any one of claims 1–3, characterised in that the polymer is dissolved at a temperature higher than or equal to the boiling point of the solvent.

11. A process according to any one of claims 1–3, characterised in that at least 50 wt. % of the solvent is removed the extruded product by a means other than extraction.

* * * * *